United States Patent [19]

Newman

[11] 4,437,189

[45] Mar. 13, 1984

[54] SOUND SYSTEM FOR A MUSICAL INSTRUMENT

[76] Inventor: Richard L. Newman, Kline Rd., Pennellville, N.Y. 13132

[21] Appl. No.: 277,997

[22] Filed: Jun. 26, 1981

[51] Int. Cl.[3] ..... H04R 1/02

[52] U.S. Cl. ..... 381/91; 381/118; 381/122

[58] Field of Search ..... 179/1 C, 1 M, 1 B, 1 AT, 179/1 E, 146 R, 151, 146 E; 381/87–91, 118, 122

[56] References Cited

U.S. PATENT DOCUMENTS 2,038,995 4/1936 Hammond, Jr. ..... 179/1 M X 3,730,046 5/1973 Spence ..... 179/1 M X 4,126,827 11/1978 Negrini ..... 179/146 R X 4,232,205 11/1980 Ribeyre ..... 179/146 R

*Primary Examiner*—A. D. Pellinen

*Assistant Examiner*—W. J. Brady

*Attorney, Agent, or Firm*—Bruns & Jenney

[57] ABSTRACT

Apparatus for connecting an electrical musical instrument to a public address system that includes a speaker having a cone-shaped diaphram, a mounting bar positioned across the mouth of the speaker and a microphone supported in the bar that passes into the cone to pick up the audio passing through the speaker and transmit the audio to a public address system.

12 Claims, 2 Drawing Figures

SOUND SYSTEM FOR A MUSICAL INSTRUMENT

BACKGROUND OF THE INVENTION

This invention relates to a sound system for use in conjunction with an electrical instrument and, in particular, to a combination speaker and microphone assembly for connecting the instrument to a public address system.

Many musical instruments that are in use today use electric amplifiers to increase the level of sound and to extend the tonal qualities of the instrument. In the case of bands or the like, which are playing to relatively large audiences, the amplified sound of the instrument is usually passed on to a public address system which carries the sound to various parts of the theater or hall in which the performance is taking place. It is customary for the musician to position a separate public address microphone in front of the amplifier cabinet. The musician, while he is playing, generally listens to his amplifier and not the public address system. Accordingly, the sound that he is hearing is oftentimes quite different from that heard by the audience. Variations in sound can be produced by simply improperly positioning the microphone in respect to the amplifier or turning the microphone so that its pickup pattern is facing in the wrong direction. Similarly, by placing the microphone too far away from the amplifier, background noise and the undesirable effects of studio acoustics will be picked up by the public address system. Support stands are available for adjustably mounting a public address microphone in relation to an amplifier. The stand generally includes a platform upon which the amplifier cabinet is seated and a swivel mount for supporting the microphone in front of the cabinet. The stand is typically a large, bulky assembly that is difficult to transport, is generally unsightly to the audience and poses an obstruction to the performer while he is on stage. While the stand does more or less bring the public address system and the amplifier together, it does not solve the problem of faithfully relating the instrument sound heard by the performer to that heard by the audience.

SUMMARY OF THE INVENTION

It is therefore an object of the present invention to improve sound systems used in association with electrically amplified musical instruments.

A still further object of the present invention is to provide an easily portable amplifier cabinet that can be connected directly into an existing public address system.

Another object of the present invention is to reduce background noise in the sound system of an electrically amplified musical instrument.

Yet another object of the present invention is to provide a speaker-microphone combination for connecting a musical instrument to a public address system whereby the sound eminating from the speaker is substantially that heard by the audience over the public address system.

A still further object of the present invention is to reduce the cost of the audio equipment needed to connect the amplifier of a musical instrument to a public address system.

These and other objects of the present invention are attained by means of a speaker that is capable of being connected to the amplifier of a musical instrument and which contains a drive section and a cone-shaped diaphram, a mounting bar attached to the speaker that extends over the mouth of the diaphram and a microphone supported in the bar which passes into the cone to pick up the audio from the speaker.

BRIEF DESCRIPTION OF THE DRAWINGS

For a better understanding of the present invention and other objects thereof reference is had to the following detailed description of the invention which is to be read in conjunction with the accompanying drawings, wherein.

DESCRIPTION OF THE INVENTION

Figure 1:
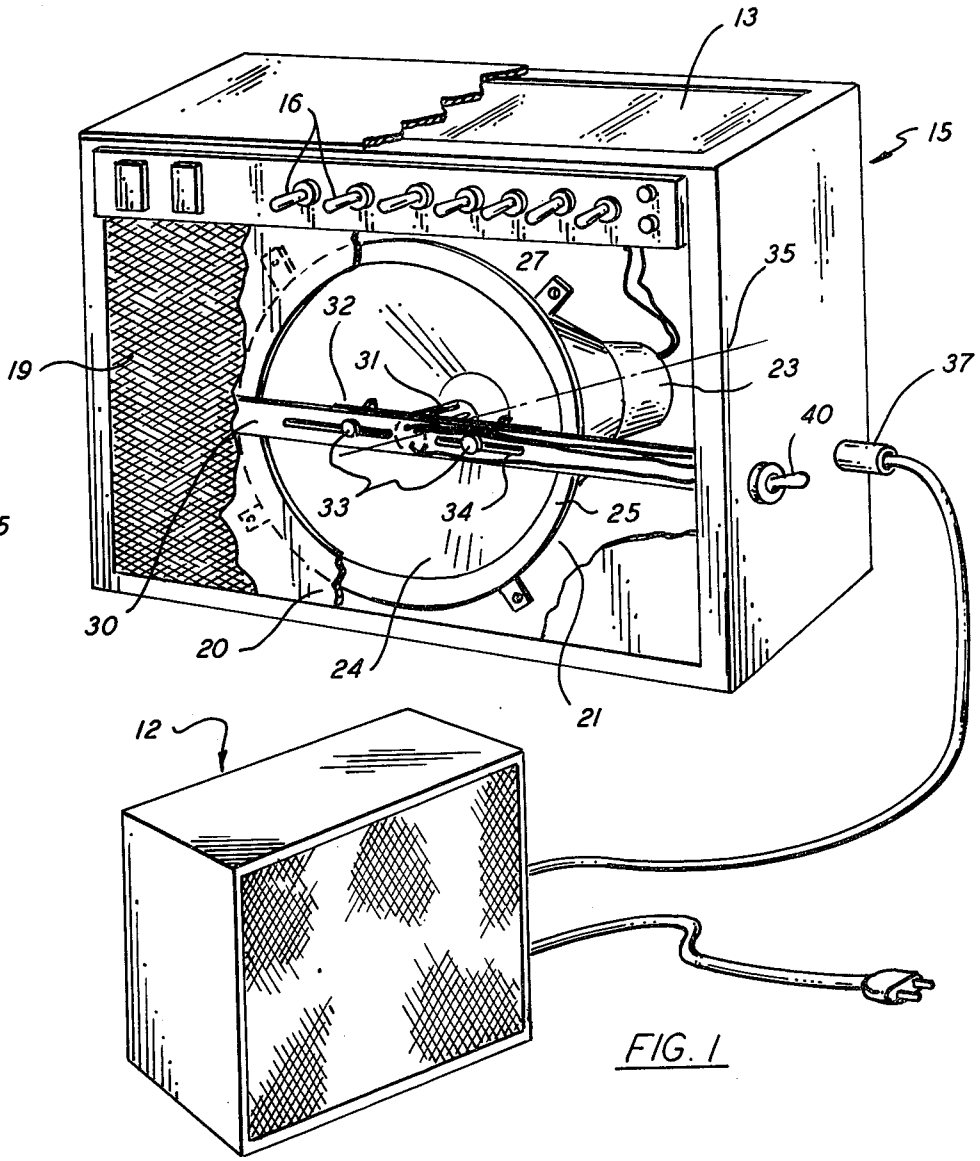
FIG. 1 is a perspective view of a sound system embodying the teachings of the present invention.

Referring now to the drawings wherein like numbers designate like parts, there is shown in FIG. 1 a sound system for connecting an electrically amplified instrument (not shown) to the output 12 of a public address speaker. Although the present system is ideally well suited for use in association with a guitar, it can be used in conjunction with any suitable electrically amplified instrument which is known and used in the art. The instrument is wired directly to an amplifier 13 that is stored in the upper part of a portable amplifier cabinet 15. Studs 16—16 that are attached to the various control circuits of the amplifier are passed through the front wall 17 of the cabinet. Knobs (not shown) are secured to the studs to permit accurate adjustment of the control circuits. A screen 19 is mounted over the front of the cabinet through which amplified sound is directed.

A recessed bulkhead 20 is mounted in the cabinet immediately behind the screen. The bulkhead is preferably made of wood and contains a circular opening therein in which is positioned a speaker which is generally referenced 21 in FIG. 1. The speaker is of conventional design and includes a drive section 23 and a speaker cone or diaphram 24. The mouth of the cone is provided with a mounting flange 25 which is securely affixed to the bulkhead by means of a plurality of clamping members 27. The speaker is wired to the outlet of the amplifier and serves to faithfully reproduce the amplified sounds of the instrument.

A horizontal mounting bar 30 is supported in the cabinet frame so that the bar extends across the mouth of the speaker in close proximity therewith. A microphone 31 is adjustably mounted in the bar upon a slidable carriage 32. The body of the microphone passes rearwardly into the speaker cone. The carriage is secured to the bar by means of a pair of thumb screws 33—33 that pass through an elongated slotted hole 34 that is formed in the bar.

The body of the microphone is preferably aligned along the axis 35 of the speaker cone. In assembly, the pickup head of the microphone is completely enclosed within the confines of the cone. The directional pickup pattern is preferably symmetrical about the axis of the microphone and is thus fully compatible with the output response of the speaker. Another advantage of placing the microphone within the speaker is the elimination of background noise and the adverse effects of studio acoustics. In the present system, the microphone is completely shielded or protected from wind by both the cabinet and the speaker and is thus ideally well suited for outdoor use.

The output leads from the microphone are carried out of the speaker along the front face of the mounting bar. The leads are connected to a standard three-pin audio outlet 37 mounted in the side wall of the cabinet which is fully compatible with most public address systems. As illustrated in FIG. 1, the outlet may be conveniently tied into the public address system whereby amplified sounds produced by the instrument are faithfully carried to the audience. A switch 40 is wired between the microphone and the outlet 37. The switch is externally mounted in the side wall of the cabinet to permit the musician to selectively disconnect the amplifier from the public address system while still being able to hear the amplifier sound.

Figure 2:
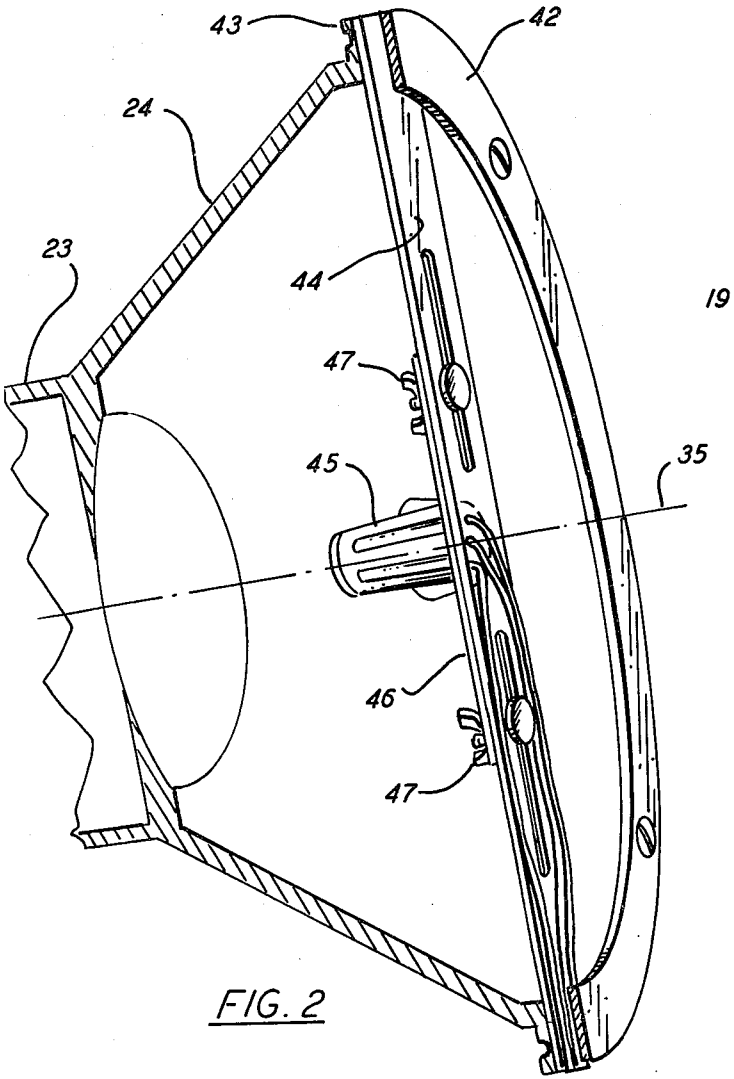
FIG. 2 is also a perspective view of a speaker-microphone combination suitable for use in the sound system illustrated in FIG. 1.

Turning now to FIG. 2, there is shown another embodiment of the speaker-microphone combination. Here again, the speaker includes a driving head and a cone that form the diaphram of the unit. A mounting ring 42 encircles the outer flange 43 of the cone and is secured thereto by means of screws 43—43. A mounting bar 44 is securely clamped between the ring 42 and the flange 43. Microphone 45 is slidably mounted within the bar so that the base of the microphone is flush with the top surface of carriage 46. The carriage is arranged to move axially along the bar in the manner described above. Thumb screws 47—47 are used to adjustably secure the carriage to the bar. The outlet leads from the microphone are passed laterally along the mounting bar and are passed under the ring to complete the assembly. The instant construction provides for a compact assembly wherein the microphone and the mounting bar are contained entirely within the cone. Accordingly, the unit can be easily installed in existing cabinets without the need of extensive reworking or the like of the cabinet.

While this invention has been described with reference to the details as set forth above, it is not limited to the specific structure as disclosed and the invention is intended to cover any modifications or changes as may come within the scope of the following claims.

I claim:

1. Apparatus for amplifying the sound of a musical instrument that includes a speaker that is arranged to be wired to the amplifier of a musical instrument which contains a drive section and an output cone wherein one end of the cone forms the mouth of the speaker, a mounting bar attached to the mouth of the speaker so that the axis of the bar is aligned along one diameter of the cone, a microphone supported in the mounting bar with the body of the microphone extending rearwardly into the cone so that it is substantially enclosed therein, and connecting means for attaching the microphone to a public address system.

2. The apparatus of claim 1 wherein the microphone is axially aligned with the central axis of the cone.

3. The apparatus of claim 1 that further includes a slide means for movably supporting the microphone in the mounting bar whereby the microphone can be adjustably positioned within the cone.

4. The apparatus of claim 1 wherein the mounting bar and the microphone are both mounted flush with the outer rim of the cone.

5. The apparatus of claim 1 wherein the connecting means includes a switch means for disconnecting the microphone from the public address system.

6. The apparatus of claim 1 wherein the microphone has a pickup pattern that is symmetrical about the axis of the cone.

7. An amplifying system for a musical instrument that includes a sound cabinet containing an amplifier, connector means for operatively connecting the amplifier to a musical instrument, a speaker having a drive section that is connected to the output of the amplifier and a cone having an enlarged mouth positioned at the front of the cabinet, a mounting bar secured to the cabinet so that it extends across the mouth of the cone, a microphone supported in said bar with the body of the microphone extending back into the cone, electrical means for wiring the output of the microphone to an outlet for connecting the microphone to a public address system.

8. The system of claim 7 wherein the microphone is axially aligned with the central axis of the cone.

9. The system of claim 7 wherein the speaker is seated in contact with the mounting bar.

10. The system of claim 7 that further includes a slide means for supporting the microphone within said cone.

11. The system of claim 7 that further includes a switch means postioned in said wiring means for disconnecting the microphones from the outlet.

12. The system of claim 7 wherein the microphone has a pickup response that is symmetrical about its axis.

* * * * *